US006319070B1

(12) United States Patent
Tan

(10) Patent No.: US 6,319,070 B1
(45) Date of Patent: Nov. 20, 2001

(54) RJ-RECEPTACLE CONNECTOR WITH ANTI-MISMATING DEVICE

(75) Inventor: Zuoxi Tan, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/752,241

(22) Filed: Dec. 28, 2000

(30) Foreign Application Priority Data

Aug. 8, 2000 (TW) ..... 89213771 U

(51) Int. Cl.[7] ..... H01R 13/64
(52) U.S. Cl. ..... 439/680; 439/676; 439/607
(58) Field of Search ..... 439/680, 677–679, 439/681, 676, 374, 607

(56) References Cited

U.S. PATENT DOCUMENTS 4,341,428 * 7/1982 Hatch et al. ..... 439/681
4,773,881 * 9/1988 Adams, III ..... 439/681
5,769,668 * 6/1998 Tondreault ..... 439/680
6,257,935 * 7/2001 Zhang et al. ..... 439/680

* cited by examiner

*Primary Examiner*—Hien Vu
(74) *Attorney, Agent, or Firm*—Wei Te Chung

(57) ABSTRACT

An electrical connector (1) includes an insulative housing (10), a terminal insert (20), an anti-mismating device (40) and a shell (30). The insulative housing defines a receiving space (11) for receiving a complementary plug connector therein. A plurality of terminals (21) is fixed to the insulative housing. The anti-mismating device is mounted in the housing at an entrance **(11*a*) of the receiving space, and comprises first and second push portions located adjacent two lateral side walls of the housing, forming, respectively, first and second stop portions (43*a*, 44*a*)** transversely extending towards each other without touching each other. The first and second push portions are independently and recoverably depressable by the complementary connector. A noncomplementary connector is blocked from insertion into the receiving space because it can depress one, but not both, push portions, and will thus be blocked by one stop portion.

3 Claims, 8 Drawing Sheets

RJ-RECEPTACLE CONNECTOR WITH ANTI-MISMATING DEVICE

BACKGROUND OF THE INVENTION

1. Field of the Invention

The present invention relates to an electrical connector, and more particularly to an RJ-receptacle connector with an anti-mismating device therein for blocking insertion of any connectors other than a complementary connector.

2. Description of the Related Art

RJ-45 plug and receptacle connectors have larger dimensions than RJ-11 plug and receptacle connectors. As a matter of fact, an RJ-11 plug connector can be mistakenly inserted into an RJ-45 receptacle connector. The erroneous insertion of an RJ-11 plug connector into an RJ-45 receptacle connector can damage the terminals in the RJ-45 receptacle connector. Copending U.S. patent application Ser. No. 09/536,165, assigned to the same assignee of the present application, discloses an RJ-45 receptacle connector with an anti-mismating device that is assembled in an entrance of a receiving space thereof. When an RJ-45 plug connector is inserted into the RJ-45 receptacle connector, the RJ-45 plug connector pushes a pair of spring arms formed on opposite ends of the anti-mismating device to move a beam formed between the pair of spring arms downwardly, thereby allowing the RJ-45 plug connector to enter the receptacle. An RJ-11 plug connector cannot simultaneously push the pair of spring arms on opposite ends of the anti-mismating device of the receptacle connector and is thus stopped by the beam from being fully inserted. This design, however, cannot always prevent the RJ-11 plug connector from entering the receptacle of the RJ-45 receptacle connector since it is possible that the RJ-11 plug connector will succeed in depressing one of the spring arms to downwardly move the beam, since the beam is integral with both of the spring arms.

Hence, an RJ-45 receptacle connector with an improved anti-mismating device is required to overcome the disadvantages of the prior art.

BRIEF SUMMARY OF THE INVENTION

An object of the present invention is to provide an RJ-45 receptacle connector having an anti-mismating device therein for blocking insertion of any connectors other than a complementary RJ-45 plug connector.

To fulfill the above-mentioned object, an RJ-45 receptacle connector with an anti-mismating device in accordance with the present invention comprises an insulative housing, a terminal insert and an anti-mismating device. The insulative housing defines a receiving space for receiving a complementary plug connector therein. A plurality of terminals is fixed in the terminal insert, which is inserted into the insulative housing. Each terminal comprises a contact portion extending into the receiving space and a solder tail extending downward from a bottom face of the insulative housing. The anti-mismating device is mounted in the housing and is located at an entrance of the receiving space. It comprises first and second push portions located adjacent two lateral side walls of the housing for being pushed by the complementary connector. A first and second stop portions are formed on the first and second push portions, respectively, for preventing a noncomplementary connector from being fully inserted into the receiving space, and the first stop portion and the second stop portion are separated from each other. A distance between the first and the second push portions is greater than a width of the noncomplementary connector, a distance between the first stop portion and the lateral side wall of the housing adjacent the second push portion is less than the width of the noncomplementary connector, and a distance between the second stop portion and the lateral side wall of the housing adjacent the first push portion is less than the width of the noncomplementary connector.

These and additional objects, features, and advantages of the present invention will become apparent after reading the following detailed description of the preferred embodiment of the invention taken in conjunction with the appended drawings.

DETAILED DESCRIPTION OF THE PREFERRED EMBODIMENTS

Figure 1:
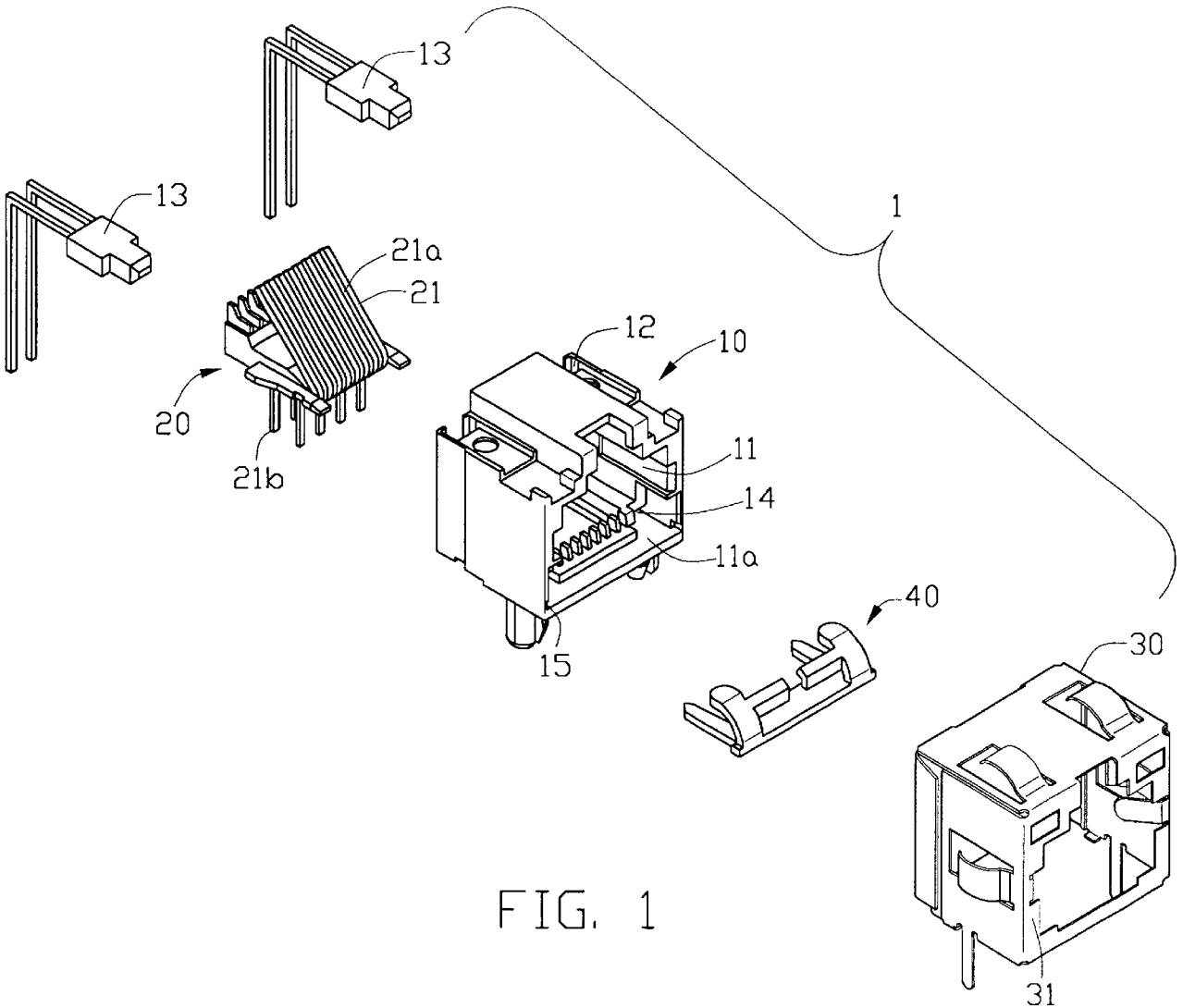
FIG. 1 is an exploded view of an RJ-45 receptacle connector in accordance with a first embodiment of the present invention.

Referring to FIG. 1, an RJ-45 receptacle connector 1 in accordance with a first embodiment of the present invention comprises an insulative housing 10, a pair of light emitting diodes 13, a terminal insert 20, a conductive shell 30 and an anti-mismating device 40.

Figure 2:
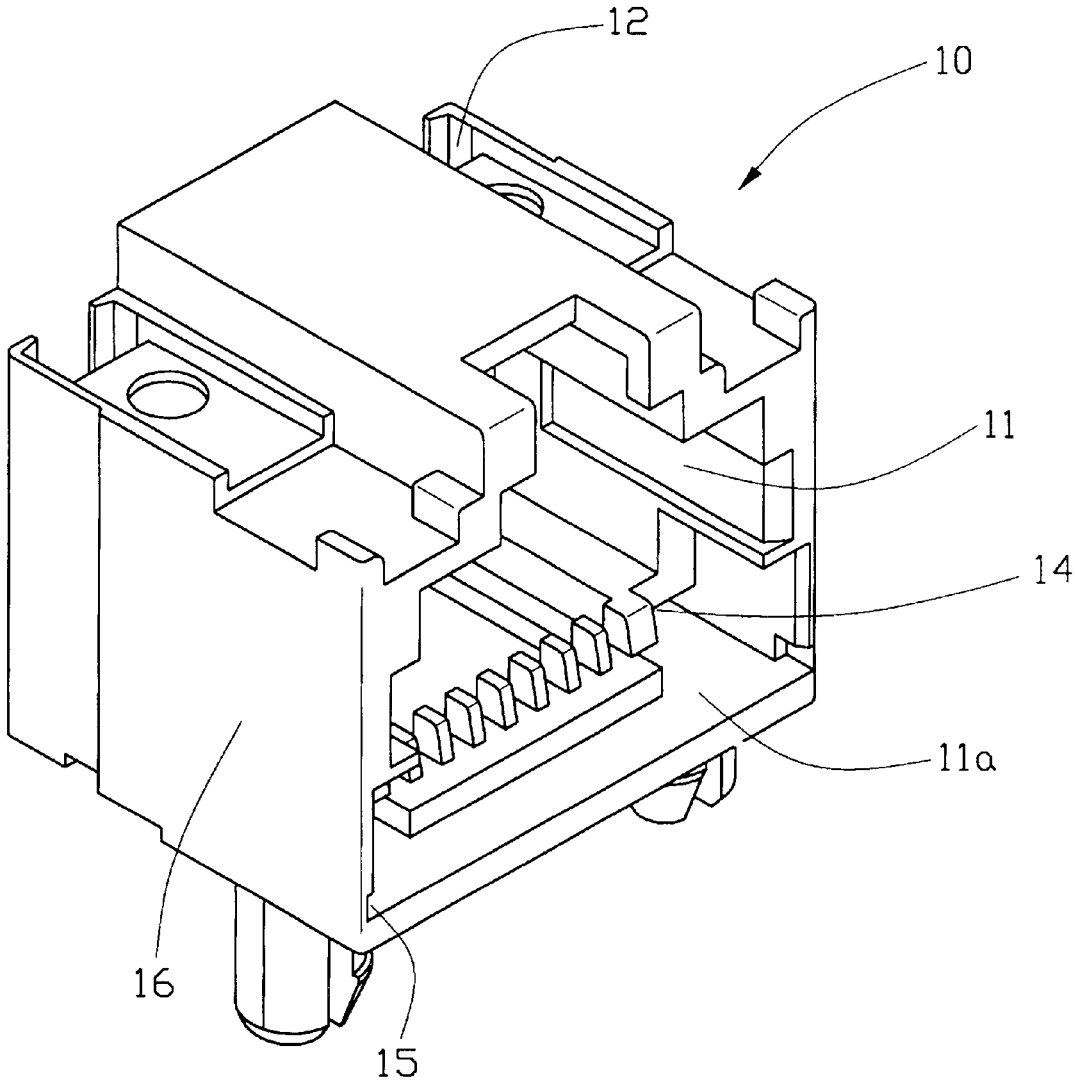
FIG. 2 is a perspective view of an insulative housing of the receptacle connector of FIG. 1.

Referring to FIG. 2, the insulative housing 10 defines a receiving space 11 for receiving a complementary RJ-45 plug connector therein (not shown). The insulative housing 10 further defines a pair of slots 12 in a top face thereof for detachably receiving the pair of light emitting diodes 13 therein. The insulative housing 10 further defines a pair of retaining recesses 14 (only one shown) in opposite lateral ends of a bottom wall (not labeled) thereof and in a front, lower portion of inner faces of a pair of side walls 16 of the housing. A pair of cutouts 15 is further defined in a front, lowermost edges of the side walls and in communication with the recesses 14.

The terminal insert 20 is insertable into the insulative housing 10 and includes a plurality of terminals 21 integrally formed therein. Each terminal 21 comprises a contact portion 21*a* extending into the receiving space 11 when the insert 20 is assembled to the insulative housing 10. Each terminal 21 further includes a solder tail 21*b* extending downward from a bottom face of the terminal insert 20 for soldering to a printed circuit board (not shown).

The anti-mismating device 40 is insertable into the receiving space 11 adjacent to an entrance 11*a* thereof to block an insertion of connectors other than the complementary RJ-45 plug connector into the receiving space 11.

Figure 3:
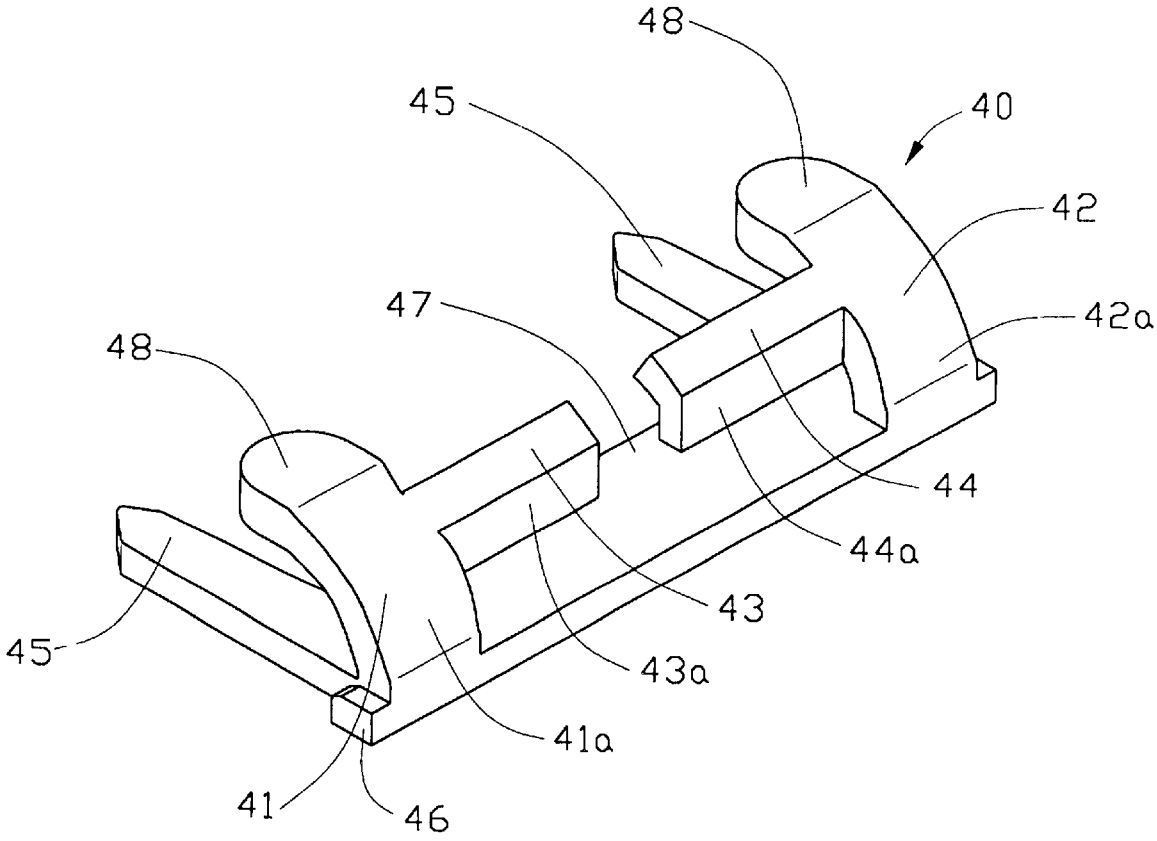
FIG. 3 is a perspective view of an anti-mismating device of FIG. 1.

Referring to FIG. 3, the anti-mismating device 40 comprises a pair of first and second spring arms 41, 42 formed at opposite ends of a connection plate 47 respectively. The first and second spring arms 41, 42 are elastically deformable, either by being made from resiliently deformable material or by mechanical design (with hinges, for instance). Each spring arm 41, 42 extends upwardly and rearwardly from a forward edge of the connection plate 47. A distance between the first spring arm 41 and the second spring arm 42 is greater than a width of a noncomplementary RJ-11 plug connector (not shown). A first beam 43 transversely extends from an inner side of the first spring arm 41 and a second beam 44 transversely extends from an inner side of the second spring arm 42 toward the first beam 43; the first and second beams 43, 44 have free ends (not labeled) facing each other. The first and second beams 43, 44 are used for preventing an insertion of the RJ-11 plug connector into the receiving space 11. A pair of retaining portions 45 integrally extends rearwardly from the connection plate 47 parallel to each other. The pair of retaining portions 45 is received in the recesses 14 of the insulative housing 10 thereby securing the anti-mismating device 40 in the housing 10. A pair of blocks 46 extends outwardly from two lateral ends of the connection plate 47. Each block 46 is received in a corresponding cutout 15 of the housing 10. The first and second spring arms 41, 42 each form a horizontal pad 48 at a free end thereof. The pad 48 is used for receiving a depressing force from the inserted RJ-45 plug connector.

A front surface of the first spring arm 41 is defined as a first push portion 41*a*, and a front surface of the second spring arm 42 is defined as a second push portion 42*a*. A front surface of the first beam 43 forms a first stop portion 43*a* and a front surface of the second beam 44 forms a second stop portion 44*a*. A distance between the free end of the first beam 43 and the side wall of the housing 10 adjacent to the second spring arm 42 is defined as a first width, which is less the width of the noncomplementary RJ-11 plug connector. A distance between the free end of the second beam 44 and the other side wall of the housing 10 adjacent to the first spring arm 41 is defined as a second width, which is also less than the width of the noncomplementary RJ-11 plug connector.

Figure 4:
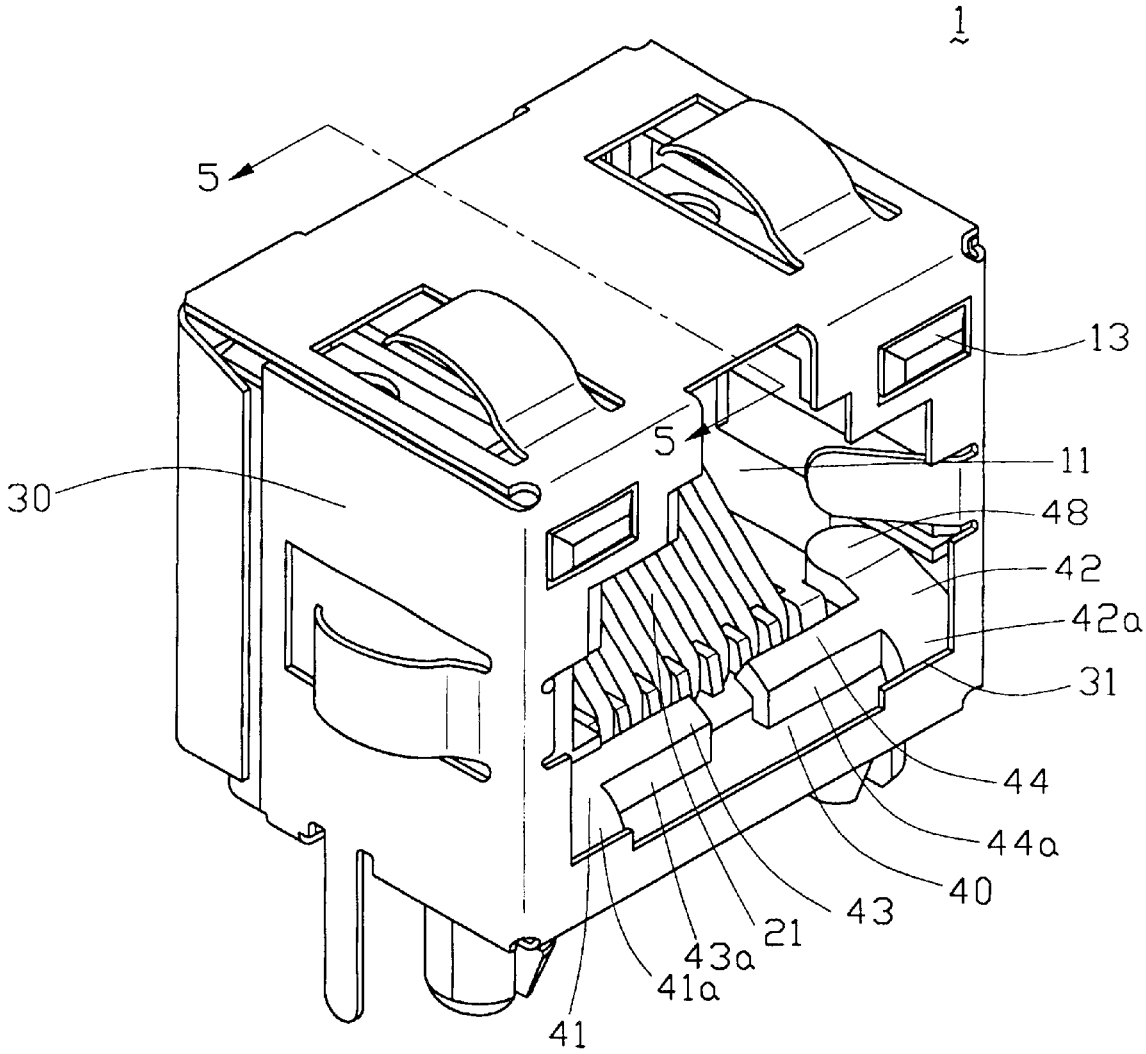
FIG. 4 is an assembled view of FIG. 1.
Figure 5:
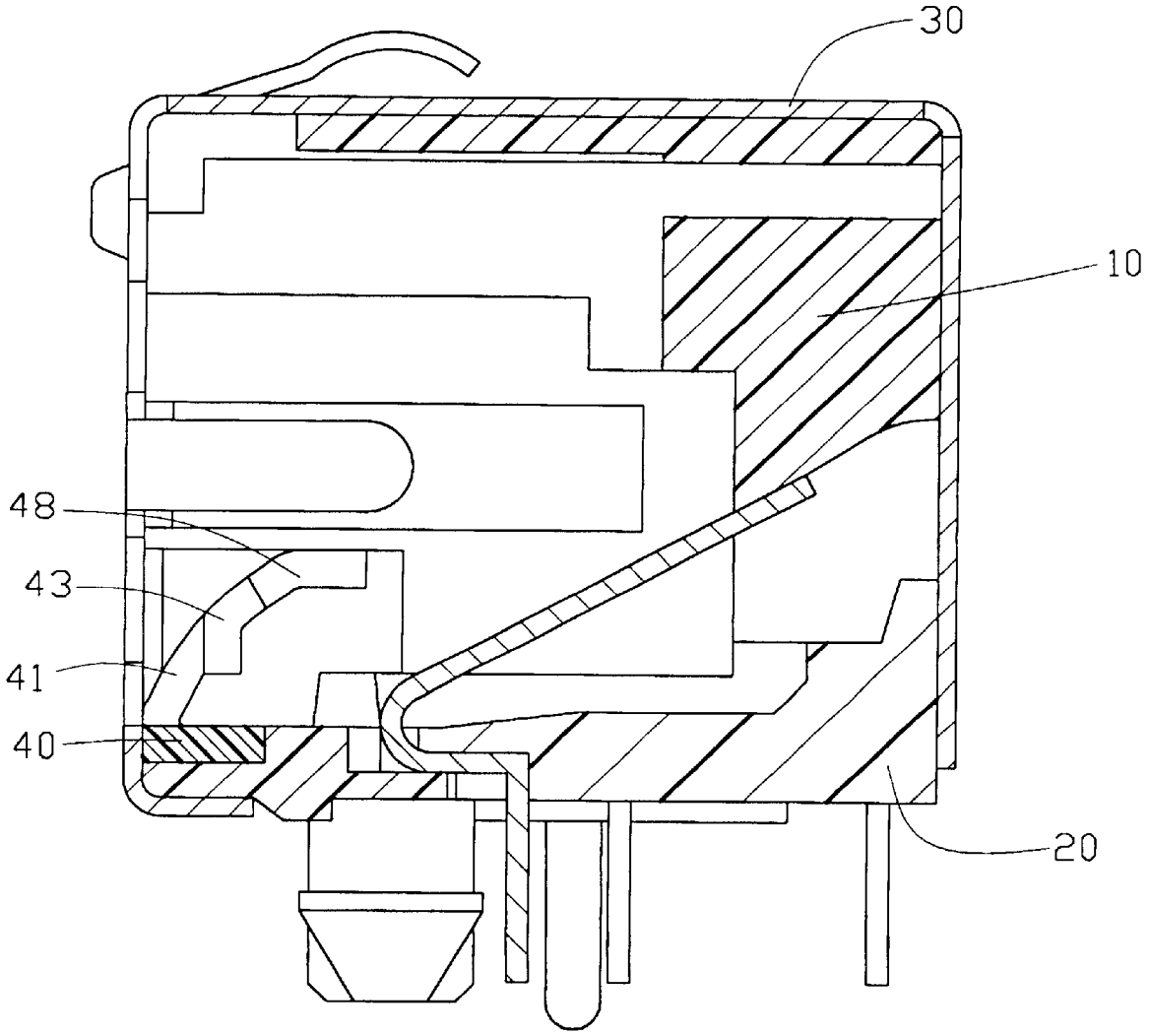
FIG. 5 is a cross sectional view taken along line 5—5 of FIG. 4.

Referring to FIG. 4 and FIG. 5, the insulative housing 10 is further enclosed by the shell 30. When the shell 30 is assembled to the insulative housing 10, a lower portion of a front wall 31 of the shell 30 abuts against a lower portion of a front face of the anti-mismating device 40, thereby preventing the anti-mismating device 40 from sliding out of the receiving space 11.

When the anti-mismating device 40 is assembled in the receiving space 11, the first and the second spring arms 41, 42 of the anti-mismating device 40 are located on both sides of the receiving space 11. The first and second beams 43, 44 are located between the first spring arm 41 and the second spring arm 42. When the noncomplementary RJ-11 plug connector is inserted into the receiving space 11 from a middle thereof, the RJ-11 plug connector cannot simultaneously press against both the first spring arm 41 and the second spring arm 42 because a distance between the inner sides of the first and second spring arms 41, 42 is greater than the width of the RJ-11 plug connector, and the plug connector is blocked from entering the receiving space 11 by the first and second stop portions 43*a*, 44*a* of the first and second beams 43, 44. In addition, when the RJ-11 plug connector is inserted into the left side of the receiving space 11, the RJ-11 plug connector can only press against the first spring arm 41. Because the width of the RJ-11 plug connector is greater than the second width, the RJ-11 plug connector is blocked from entering the receiving space 11 by the second stop portion 44*a* of the second beam 44. Alternatively, when the RJ-11 plug connector is inserted into the right side of the receiving space 11, because the width of the RJ-11 plug connector is greater than the first width, it is blocked from entering the receiving space 11 by the first stop portion 43*a* of the first beam 43.

However, when the RJ-45 plug connector is inserted into the receiving space 11, because the width of the RJ-45 plug connector is the same as the width of the receiving space 11, a bottom edge of the RJ-45 plug connector will simultaneously press against the first and second push portions 41*a*, 42*a* and then the pads 48 of the first and second spring arms 41, 42. The first and second stop portions 43*a*, 44*a* of the first and second beams 43, 44 will then be driven by the spring arms 41, 42 to move downwardly. The bottom edge of the RJ-45 plug connector will slide over the anti-mismating device 40, enabling the RJ-45 plug connector to enter the receiving space 11.

Figure 6:
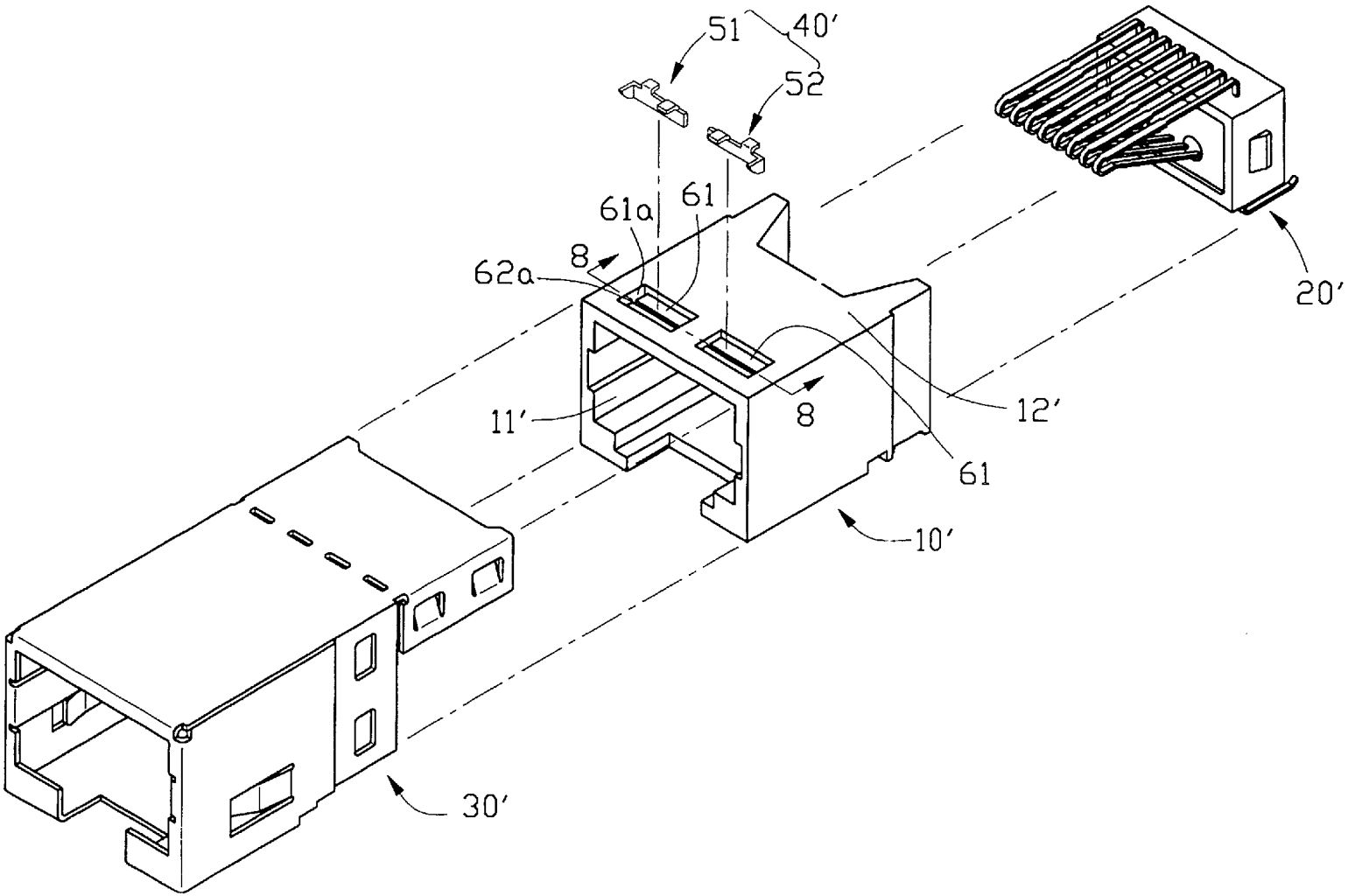
FIG. 6 is an exploded view of an RJ-45 receptacle connector in accordance with a second embodiment of the present invention.
Figure 7:
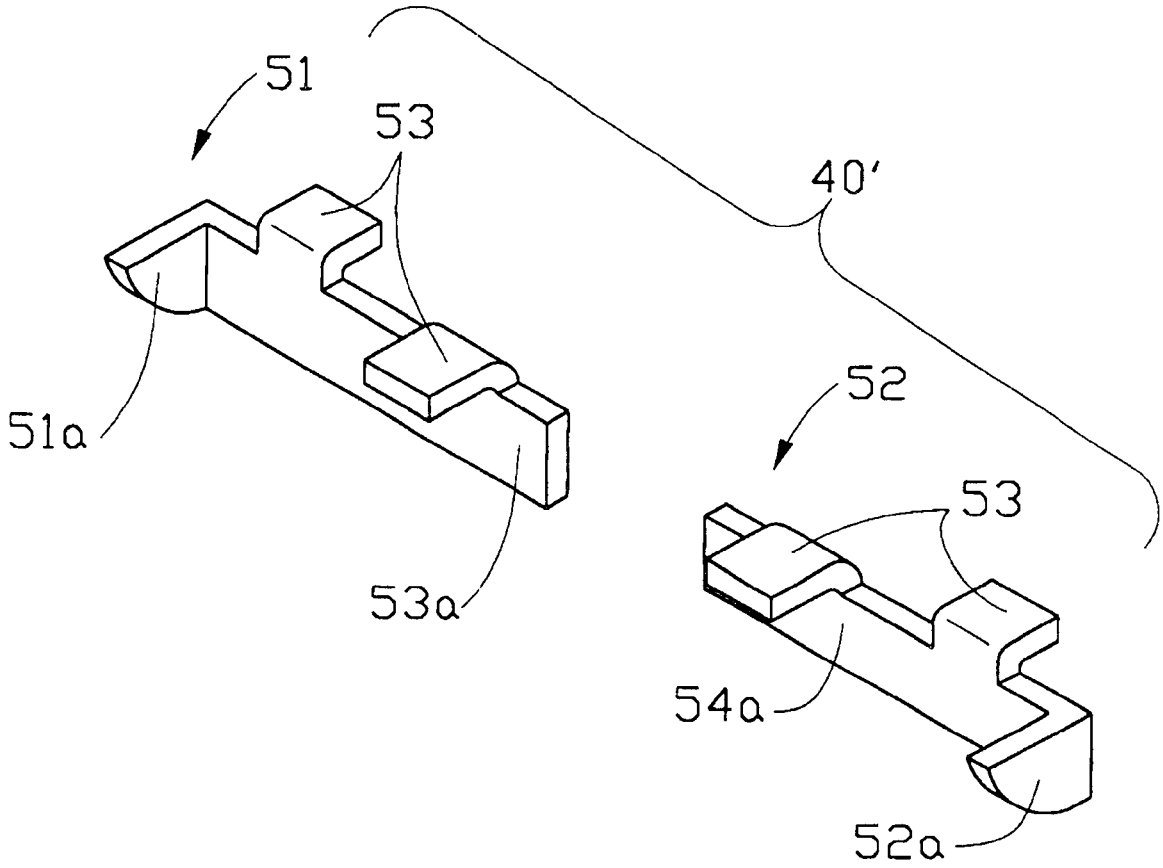
FIG. 7 is a perspective view of an anti-mismating device of FIG. 6.
Figure 8:
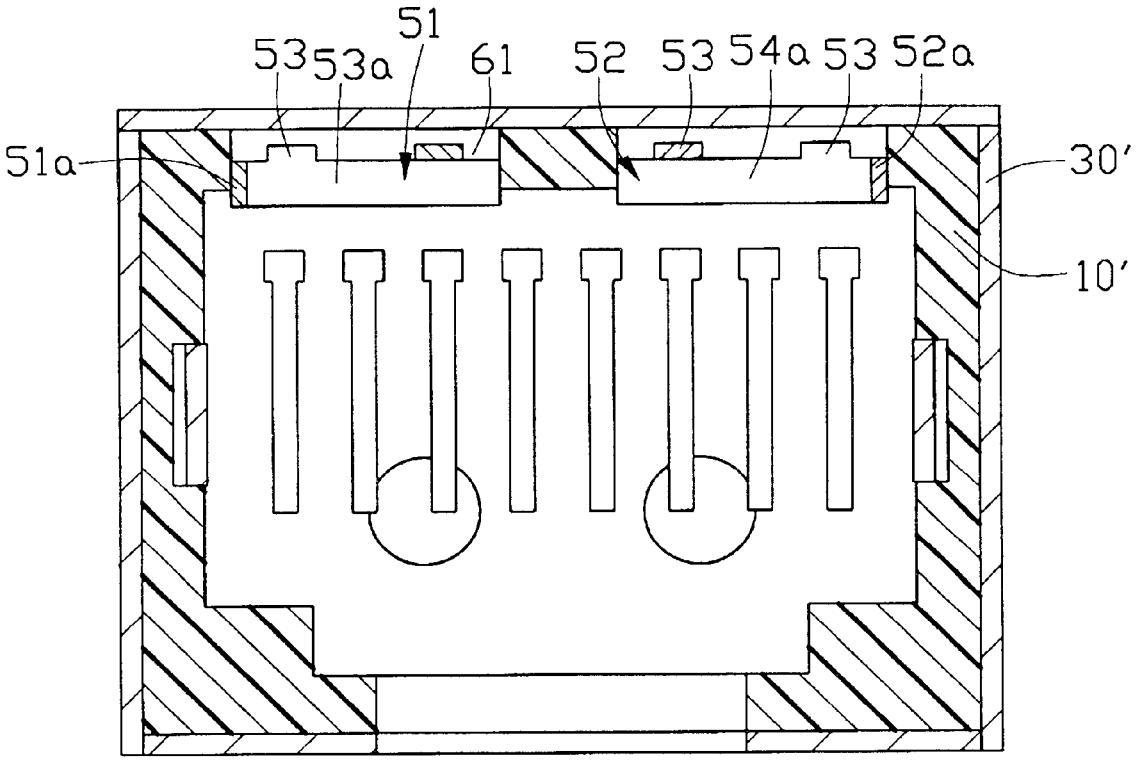
FIG. 8 is a cross sectional view taken along line 8—8 of FIG. 6.

Referring to FIG. 6 to FIG. 8, a second embodiment of the present invention comprises an insulative housing 10', a terminal insert 20', a conductive shell 30' and an anti-mismating device 40'. Comparing with the first embodiment of the invention, the critical differences therebetween are in the anti-mismating device and the structure of the housing for receiving the anti-mismating device. The anti-mismating device 40' in accordance with the second embodiment comprises two push pads 51, 52 having similar structures and being separately assembled in two opposite sides of a top wall 12' of the housing 10'.

The push pad 51 is L-shaped and includes a first stop portion 53*a* for stopping insertion of the noncomplementary plug connector, an arcuate first push portion 51*a* extending forwardly from one end of the first stop portion 53*a* and a pair of baffles 53 extending forwardly and rearwardly from a top edge (not labeled) of the first stop portion 53*a*. The arcuate first push portion 51*a* is perpendicular to the first stop portion 53*a*. Both of the baffles 53 are in a plane perpendicular to the plane of the first stop portion 53*a* and also perpendicular to the plane of the arcuate first push portion 51*a*.

The push pad 52 includes a second stop portion 54*a* for stopping the insertion of the noncomplementary plug connector and an arcuate second push portion 52*a* extending from one end of the second stop portion 54*a* opposite the arcuate first push portion 51 a and a pair of baffles 53 extending forwardly and rearwardly from a top edge (not labeled) of the second stop portion 54*a*. The arcuate second push portion 52*a* is perpendicular to the second stop portion 54*a*. The baffles 53 are perpendicular to the second stop portion 54*a* and to the arcuate second push portion 52*a*.

The top wall 12' of the insulative housing 10' of the second embodiment defines two identical recesses 61 therein equally spaced from and at opposite sides of a longitudinal centerline (not labeled) thereof. A first slit 61*a* is defined through the top wall 12' in a bottom of each recess 61, near a corresponding side wall of the housing 10' and oriented along a front-to-rear direction of the housing 10' for receiving the first and second push portions 51*a*, 52*a* of push pads 51, 52, respectively. A pair of second slits 62 is defined through the top wall 12', one in each recess 61, aligned with one another in a direction perpendicular to the corresponding first slits 61*a*. Each second slit 62 communicates with its corresponding first slit 61*a*.

The push pads 51 and 52 are assembled in the insulative housing 10' with the baffles 53 of the push pads 51, 52 located against the top wall 12' in the recesses 61. The first and second push portions 51*a*, 52*a* are received in the first slits 61*a* with arcuate lower edges thereof protruding into the receiving space 11'. The first and second stop portions 53*a*, 54*a* are received in the second slits 62 with lower edges thereof protruding into the receiving space 11'. When the push pads 51, 52 are pushed upwardly by the complementary plug connector, the push pads 51, 52 can only move in the notches 61 and are prevented from escaping from the notches 61 because the shell 30' surrounds the insulative housing 10'.

A distance between the first and second push portions 51*a*, 52*a* is greater than the width of the noncomplementary RJ-11 plug connector. A distance between one of inner ends of the first and second stop portions 53*a*, 54*a* and an inner side wall of the housing 10' close to the other push pad is less than the width of the noncomplementary plug connector. Therefore, regardless of the location at which the noncomplementary plug connector is inserted into the RJ-45 receptacle connector, an upper portion thereof will be stopped by the first or second stop portions 53*a*, 54*a* of push pads 51 or 52; thus the noncomplementary plug connector cannot be inserted into the RJ-45 receptacle connector in accordance with the second embodiment of the present invention.

When a complementary RJ-45 plug connector is inserted into the RJ-45 receptacle connector, the anti-mismating device 40' is pushed upward due to an engagement of a top, front edge of the plug connector with the first and second push portions 51*a*, 52*a*. When the mating connector is pulled out, the anti-mismating device 40' returns to its downward position due to gravity.

It is to be understood, however, that even though numerous characteristics and advantages of the present invention have been set forth in the foregoing description, together with details of the device and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An RJ-receptacle connector comprising:

an insulative housing defining a receiving space for receiving a complementary plug connector therein;

a plurality of terminals fixed in the insulative housing, each terminal comprising a contact portion extending into said receiving space and a solder tail extending downward from a bottom face of said insulative housing; and an anti-mismating device mounted in the housing, located at an entrance of the receiving space and comprising first and second push portions thereon, when assembled in the housing, adjacent two lateral side walls of the housing and independently and recoverably depressable by the complementary connector, the first and second push portions respectively forming first and second stop portions transversely extending towards each other, without touching each other, for preventing a noncomplementary connector from being inserted into the receiving space, the first stop portion and the second stop portion being separated from each other, wherein a distance between the first and the second push portions is greater than a width of the noncomplementary connector, a shortest distance from the first stop portion to an inner surface of the lateral side wall of the housing adjacent the second push portion is less than the width of the noncomplementary connector, and a shortest distance from the second stop portion to an inner surface of the lateral side wall of the housing adjacent tie first push portion is less than the width of the noncomplementary connector; wherein the anti-mismating device comprises a first spring arm, a second spring arm and a connection plate, the first spring arm and the second spring arms being connected to opposite ends of the connection plate; wherein the first push portion and the second push portion are defined on the first spring arm and the second spring arm, respectively, and the first stop portion and the second stop portion are defined on a fist beam and a second beam, respectively, wherein the first and second beams extend from the first and second spring arms, respectively, in a direction toward each other; wherein the anti-mismating device further defines a pair of pads at free ends of the first and second spring arms adapted for receiving a depressing force of the complementary plug connector; wherein a bottom wall of the insulative housing defines a pair of recesses, and the connection plate forms a pair of retaining portions at its opposite ends, the retaining portions each extending into a corresponding recess thereby fixing the anti-mismating device to the housing; wherein said first and second push portions are perpendicular to the two stop portions, respectively, each push portion having an arced bottom edge projectable into the receiving space.

2. A modular jack receptacle connector, comprising:

a dielectric housing defining a plug connector receiving space therein;

a plurality of conductive terminals fixed in the housing, each terminal having a contact portion extending into the receiving space;

an anti-mismating device mounted to the housing, the device comprising:

a push portion located near each of two sidewalls of the housing between which the receiving space is located; and a stop portion extending from a corresponding push portion toward a middle of the housing, said stop portions each having a part extending into the receiving space to prevent a non-complementary plug connector from entering the receiving space, wherein, when a complementary plug connector is inserted into the receiving space, both push portions are actuated to move the stop portions away from the receiving space, and when a noncomplementary plug connector is inserted into the receiving space, the noncomplementary plug connector is blocked from entering the receiving space by at least one of the stop portions; wherein the anti-mismating device comprises a first spring arm, a second spring arm and a connection plate, the first spring arm and the second spring arms being connected to opposite ends of the connection plate; wherein the first push portion and the second push portion are defined on the first spring arm and the second spring arm, respectively, and the first stop portion and the second stop portion are defined on a first beam and a second beam, respectively, wherein the first and second beams extend from the first and second spring arms, respectively, in a direction toward each other; wherein a bottom wall of the insulative housing defines a pair of recesses, and the connection plate forms a pair of retaining portions at its opposite ends, the retaining portions each extending into a corresponding recess thereby fixing the anti-mismating device to the housing; wherein the modular jack receptacle connector further comprises a conductive shell, and when the shell is assembled to the insulative housing, a lower portion of a front wall of the shell abuts against a lower portion of a front face of the anti-mismating device, thereby preventing the anti-mismating device from sliding out of the receiving space.

3. The modular jack receptacle connector as claimed in claim 2, wherein a distance between the two push portions is greater than the width of the noncomplementary plug connector.

* * * * *